US012397396B2

(12) United States Patent
Yamaguchi et al.

(10) Patent No.: US 12,397,396 B2
(45) Date of Patent: Aug. 26, 2025

(54) METHOD FOR MANUFACTURING POROUS METAL BONDED GRINDSTONE, AND METHOD FOR MANUFACTURING POROUS METAL BONDED WHEEL

(71) Applicant: NORITAKE CO., LIMITED, Nagoya (JP)

(72) Inventors: Masaru Yamaguchi, Nagoya (JP); Daiki Furuno, Nagoya (JP)

(73) Assignee: NORITAKE CO., LIMITED, Nagoya (JP)

( * ) Notice: Subject to any disclaimer, the term of this patent is extended or adjusted under 35 U.S.C. 154(b) by 324 days.

(21) Appl. No.: 18/251,644

(22) PCT Filed: Oct. 14, 2021

(86) PCT No.: PCT/JP2021/038076
§ 371 (c)(1),
(2) Date: May 3, 2023

(87) PCT Pub. No.: WO2022/102335
PCT Pub. Date: May 19, 2022

(65) Prior Publication Data

US 2023/0405764 A1 Dec. 21, 2023

(30) Foreign Application Priority Data

Nov. 10, 2020 (JP) ..... 2020-187173

(51) Int. Cl.
*B24D 3/10* (2006.01)

(52) U.S. Cl.
CPC ..... *B24D 3/10* (2013.01)

(58) Field of Classification Search
CPC ..... B24D 3/10; B24D 3/06
See application file for complete search history.

(56) References Cited

U.S. PATENT DOCUMENTS 4,917,960 A 4/1990 Hornberger
2003/0097800 A1* 5/2003 Ramanath ..... C09K 3/1409 51/309

FOREIGN PATENT DOCUMENTS

CN 101450463 A 6/2009
CN 101528954 A 9/2009
(Continued)

OTHER PUBLICATIONS

The International Preliminary Report on Patentability for the corresponding international application No. PCT/JP2021/038076 issued May 16, 2023, which includes English translation of Written Opinion of the International Searching Authority for the corresponding international application No. PCT/JP2021/038076 mailed Dec. 7, 2021.

(Continued)

*Primary Examiner* — Pegah Parvini
(74) *Attorney, Agent, or Firm* — Muncy, Geissler, Olds & Lowe, P.C.

(57) ABSTRACT

A method for manufacturing a porous metal bonded grindstone with which it is possible to arbitrarily adjust a porosity from a low porosity to a high porosity is provided. This method is intended for manufacturing the porous metal bonded grindstone and comprises: a molding step (P1) for obtaining an unfired molded body including abrasive grains, metal powder, and a pore forming material; a solute removing step (P2) for bringing vapor of a solvent having solubility with respect to the pore forming material into contact with the unfired molded body to remove the pore forming material and to obtain an unfired molded body having pores; and a firing step (P3) for firing the unfired molded body having pores.

7 Claims, 3 Drawing Sheets

(56) References Cited

FOREIGN PATENT DOCUMENTS

| | | | | | |
|---|---|---|---|---|---|
| JP | 63-212059 | A | * | 9/1988 | ..... B22D 19/00 |
| JP | S63212059 | A | | 9/1988 | |
| JP | H08-81703 | A | | 3/1996 | |
| JP | 2001088035 | A | | 4/2001 | |
| JP | 2005525242 | A | | 8/2005 | |
| JP | 2008030194 | A | | 2/2008 | |
| JP | 2010540261 | A | | 12/2010 | |
| JP | 2019104079 | A | | 6/2019 | |
| WO | WO-2016081302 | A1 | * | 5/2016 | ..... B24D 18/0009 |

OTHER PUBLICATIONS

The First Office Action of the corresponding CN application No. 202180075016.7 mailed May 30, 2025 and English translation thereof.

* cited by examiner

[Fig. 1]
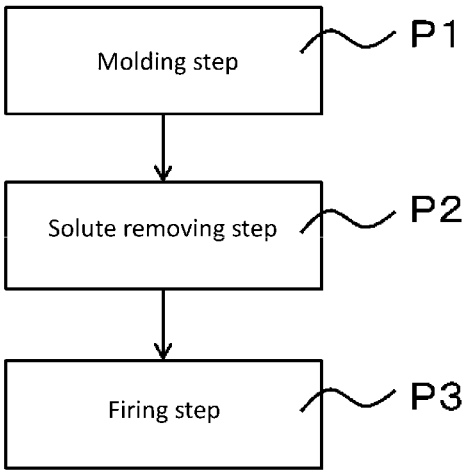
[Fig. 2]
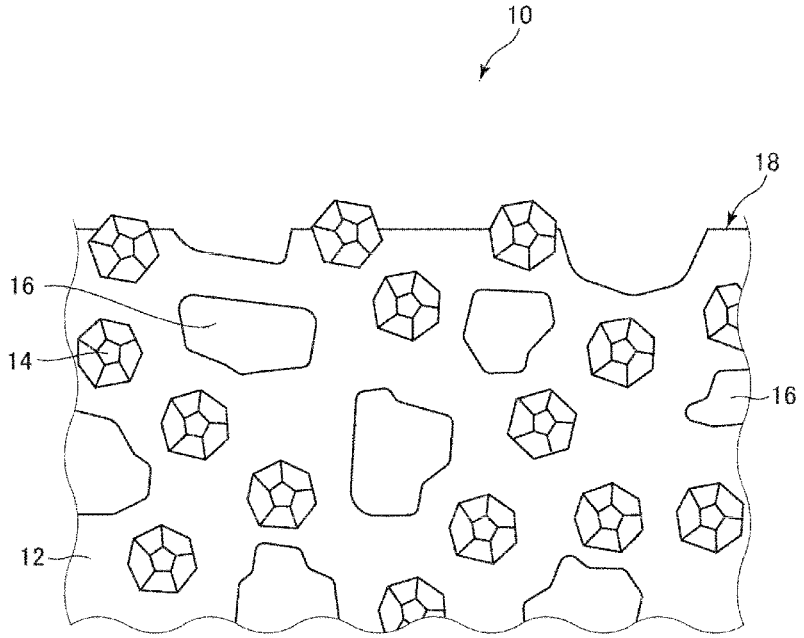

[Fig. 3]
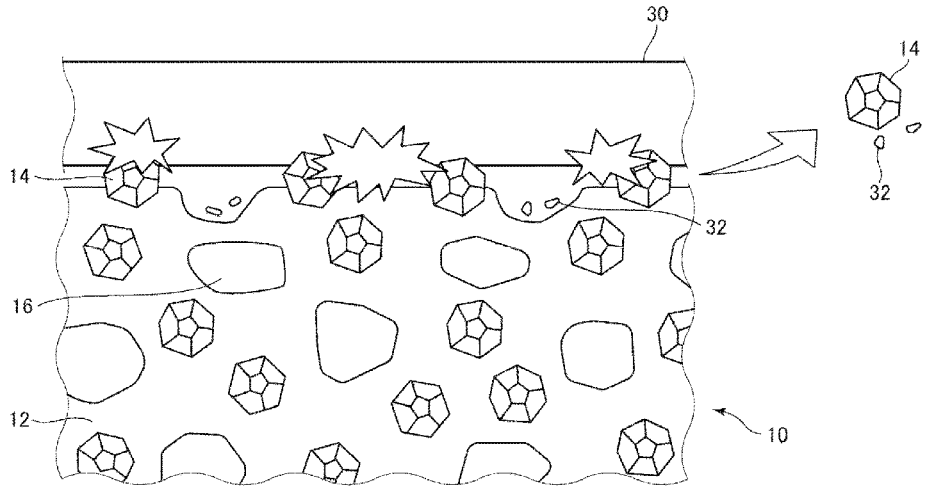
[Fig. 4]
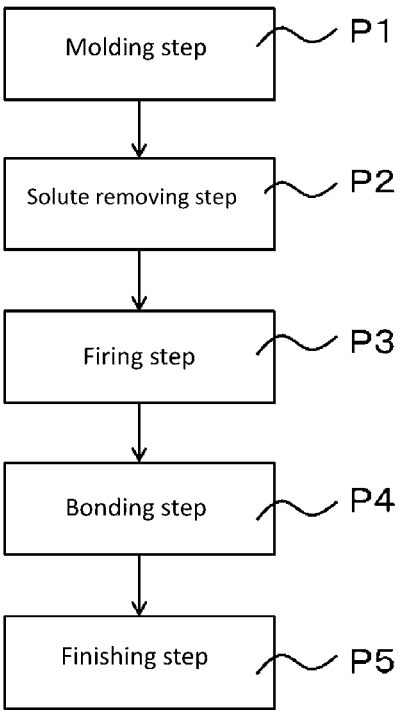

[Fig. 5]
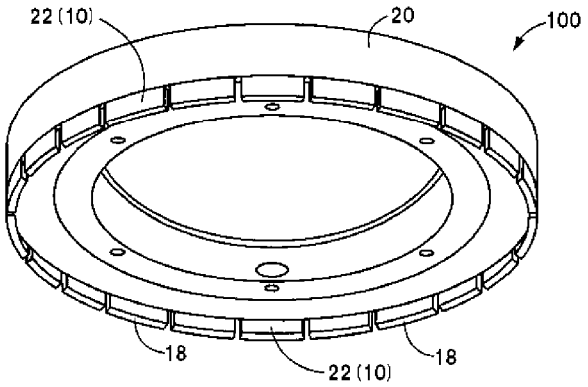
[Fig. 6]
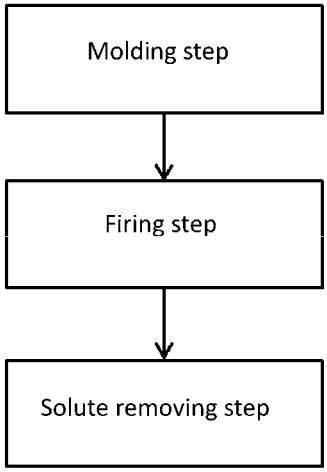

METHOD FOR MANUFACTURING POROUS METAL BONDED GRINDSTONE, AND METHOD FOR MANUFACTURING POROUS METAL BONDED WHEEL

TECHNICAL FIELD

The present invention relates to a method for manufacturing a porous metal bonded grindstone. The present invention also relates to a method for manufacturing a porous metal bonded wheel.

BACKGROUND ART

Conventionally, a vitrified bonded grindstone has been used as a grindstone suitable for grinding high-hardness fragile materials by a stable grinding capability with high efficiency and a long-life duration. Conventionally, there has not been much demand for grinding high-hardness fragile materials and it was sufficient to perform this by taking time for the grinding. However, as the power device market and LED market expand, the demand for the processing with high efficiency and a long-life duration has increased for such grinding, for the purpose of productivity improvement and processing cost reduction. Therefore, a grindstone for achieving these purposes is required.

In a high-efficiency and high-precision processing field and in a processing field called super finishing for the above high-hardness fragile materials, porous metal bonded grindstones are sometimes used as a tool which is superior in having a long-life duration. As methods for manufacturing the porous metal bonded grindstones, there have been known, for example, a method for forming pores by adding closed-cell cellular materials such as hollow fine particles, a method for forming pores by adding organic media and burning-through by firing, and a method for forming pores by adding salt and eluting it in a solvent after firing.

For example, Patent Literature 1 discloses a porous grindstone characterized in that abrasive grains and inorganic hollow fine particles disperse in a metal binder or a vitreous binder. Patent Literature 1 also discloses that a mixture powder obtained by mixing the abrasive grains, the hollow fine particles, and the powder of the metal binder is heated and cooled after melting the metal binder, so that the porous grindstones can be manufactured.

Patent Literature 2 discloses a composite material for grinding a workpiece composed of a hard material to achieve desired surface finishing, the composite material containing specific abrasive grains, a specific metal binder, and porous portions at a specific ratio, as well as a method for manufacturing the same. Patent Literature 2 also describes immersing an abrasive article in a solvent to leach out the dispersoid, so that interconnected pores are left in the abrasive article.

Patent Literature 3 discloses a method for manufacturing an abrasive article with interconnected pores of at least 50 vol %, the method comprising the steps of: (a) admixing a mixture containing abrasive grains of about 0.5 to about 25 vol %, a binder of about 19.5 to about 49.5 vol %, and dispersoid particles of about 50 to about 80 vol %; (b) pressing the mixture into a composite material filled with abrasive materials; (c) performing thermal processing on the composite material; and (d) immersing the composite material in a solvent in which the dispersoid particles are dissolved over a fixed time suitable for substantially dissolving all of the dispersoid particles, wherein the abrasive grains and the binder are substantially insoluble with respect to the solvent.

CITATION LIST

Patent Literature

Patent Literature 1: JP 2001-88035 A
Patent Literature 2: JP 5314030 B2
Patent Literature 3: JP 2008-30194 A

SUMMARY OF INVENTION

Technical Problem

As in Patent Literature 1, in the method for forming the pores by using the closed-cell cellular materials such as hollow fine particles, porosity can be adjusted in accordance with the amount of addition of the closed-cell cellular materials. However, the contours of the pores remain as unnecessary residues and therefore, in case of using the grindstone as the tool, the residues contact with the workpiece at the time of processing, so that there is concern about grinding burning accompanied by increase in resistance and deterioration of processing precision.

According to a method for causing a pore forming material such as a dispersoid to be eluted into a solvent in order to form the pores, no unnecessary residues such as the contours of the closed-cell cellular materials remain. Further, as shown in FIG. 6, according to the conventional method for manufacturing a porous metal bonded grindstone, a solute removing step is carried out after a firing step. After undergoing the firing step, a fired body in which the abrasive grains are strongly adhered to a metal bond can be obtained, it is possible to suppress the strength of the metal bond and the adhesion force of the abrasive grains from lowering even if the fired body is immersed in the solvent, and the pore forming material can be eluted. However, since the metal bond is strongly fired and hardened, the pore forming materials need to interconnect with each other in order to allow the solvent to penetrate. If the ratio of the pore forming materials in the fired body is too low, there occurs a portion in which the pore forming materials do not interconnect with each other, so that the solvent cannot penetrate, thus making it difficult to elute the pore forming materials. The pores need to interconnect with each other in order to dissipate all the dispersoids. For example, according to the methods of Patent Literatures 2 and 3, the dispersoids of at least 40 vol % need to be added. However, in case of using, as the tool, a grindstone with the porosity of at least 40 vol %, the following problem occurs depending on the material to be ground: the grindstone has high sharpness, while having low wear resistance when the metal bonded portion is reduced. Thus, there were also cases in which a grindstone with a lower porosity was required.

The present invention is made in consideration of the above circumstances and the object of the present invention is to provide a method for manufacturing porous metal bonded grindstones which uses pore forming materials which enable the elution by the solvent and with which it is possible to adjust the porosity arbitrarily from a low porosity to a high porosity, as well as a method for manufacturing porous metal bonded wheels using the same.

Solution to Problem

As a result of continuing to research intensely in order to solve the above problem, the present inventors have found out that the following invention conforms to the above object and have conceived the present invention.

Namely, the present invention relates to the following invention.

<1> A method for manufacturing a porous metal bonded grindstone, comprising: a molding step for obtaining an unfired molded body including abrasive grains, metal powder and a pore forming material; a solute removing step for bringing vapor of a solvent having solubility with respect to the pore forming material into contact with the unfired molded body to remove the pore forming material and to obtain an unfired molded body having pores; and a firing step for firing the unfired molded body having pores.

<2> The method for manufacturing a porous metal bonded grindstone according to above <1>, wherein a volume ratio of the pore forming material to the unfired molded body is from 5 to 90 vol %.

<3> The method for manufacturing a porous metal bonded grindstone according to above <1> or <2>, wherein an average particle size of the pore forming material is from 5 to 250 μm.

<4> The method for manufacturing a porous metal bonded grindstone according to any of above <1> to <3>, wherein the solvent contains at least one selected from the group consisting of water, alcohol, and acetone.

<5> The method for manufacturing a porous metal bonded grindstone according to any of above <1> to <4>, wherein the solvent contains water and the pore forming material is a water-soluble compound.

<6> The method for manufacturing a porous metal bonded grindstone according to above <5>, wherein the pore forming material is a water-soluble inorganic salt.

<7> A method for manufacturing a porous metal bonded wheel, comprising the steps of: bonding, to a base metal, a porous metal bonded grindstone manufactured in accordance with the method for manufacturing the porous metal bonded grindstone according to any of above <1> to <4>; and finishing the porous metal bonded grindstone bonded to the base metal by using a dresser.

Advantageous Effects of Invention

According to the present invention, the method for manufacturing the porous metal bonded grindstone which uses pore forming materials which enable the elution by the solvent and with which it is possible to adjust the porosity arbitrarily from a low porosity to a high porosity is provided. In this manner, the porous metal bonded grindstone in which the influence of the unnecessary residue such as the contour of the closed-cell cellular material is suppressed, can be obtained with a desired porosity.

Further, the method for manufacturing the porous metal bonded wheel comprising the porous metal bonded grindstone having an arbitrary porosity from a low porosity to a high porosity is provided.

BRIEF DESCRIPTION OF DRAWINGS

FIG. 1 is a process chart of the method for manufacturing the porous metal bonded grindstone in the present invention.

FIG. 2 is a partial cross sectional schematic drawing showing the grindstone manufactured in accordance with the method for manufacturing the porous metal bonded grindstone in the present invention.

FIG. 3 is a drawing for explaining a state of the porous metal bonded grindstone of the present invention at the time of grinding.

FIG. 4 is a process chart of the method for manufacturing the porous metal bonded wheel in the present invention.

FIG. 5 is a perspective view showing one example of a porous metal bonded grindstone manufactured in accordance with the method for manufacturing the porous metal bonded wheel in the present invention.

FIG. 6 is a process chart of the method for manufacturing the conventional porous metal bonded grindstone.

DESCRIPTION OF EMBODIMENTS

Hereinafter, embodiments of the present invention will be explained in detail. The following explanation about the components relates to one example (representative example) of an aspect of the present invention and is not limited to the following contents as far as the gist of the present invention is not changed. When the expression "[ . . . ] to [ . . . ]" is used in the present specification, it is used as the expression including the numerical values or the physical property values before and after this expression.

<Method for Manufacturing Porous Metal Bonded Grindstone in the Present Invention>

The present invention relates to a method for manufacturing a porous metal bonded grindstone, comprising: a molding step for obtaining an unfired molded body including abrasive grains, metal powder and a pore forming material; a solute removing step for bringing vapor of a solvent having solubility with respect to the pore forming material into contact with the unfired molded body to remove the pore forming material and to obtain an unfired molded body having pores; and a firing step for firing the unfired molded body having pores (hereinafter sometimes referred to as "the method for manufacturing the grindstone in the present invention").

The method for manufacturing the grindstone in the present invention is characterized in that the pore forming material is removed while the molded body is in the unfired state and the vapor is used for removing the pore forming material. As described above, the pore forming material is removed while the molded body is in the unfired state (namely, the solute removing step is carried out before the firing step), so that the molded body is not strongly fired and hardened, and therefore the vapor of the solvent easily penetrates into its inside. Therefore, even if the amount of the pore forming materials is small, the vapor of the solvent can penetrate into the inside of the molded body and the pore forming material can be sufficiently eluted. Further, the molded body is made to contact with the vapor of the solvent without immersing the molded body in the solvent, so that the vapor easily penetrates further into the interior of the molded body. Further, since the unfired molded body has a low shape stability, the shape is likely to dissolve when the unfired molded body is immersed in the solvent. Meanwhile, according to the method for manufacturing the grindstone in the present invention, the unfired molded body is made to contact with the vapor of the solvent, so that the shape of the molded body is difficult to dissolve even if it is unfired. By firing the thus obtained unfired molded body having pores formed therein, the metal powder is melted and fired while the pores remain maintained as they are, so that it is possible to manufacture the porous metal bonded grindstone with the pore forming material sufficiently removed in spite of the low porosity.

FIG. 1 is a process chart of the method for manufacturing the porous metal bonded grindstone in the present invention. Hereinafter, each step will be explained based on FIG. 1.

[Molding Step (P1)]

The molding step is a step for obtaining the unfired molded body including the abrasive grains, the metal powder, and the pore forming material.

(Abrasive Grains)

As the abrasive grains, diamonds, etc. can be used. The average particle size of the abrasive grains can be appropriately selected based on the type of a material to be ground, etc. In case of grinding high-hardness fragile materials such as a silicon carbide and a sapphire, the abrasive grains deeply eat into the high-hardness fragile material and the damage reaches its interior, so that the processing time becomes long during the next step. When the average particle size of the abrasive grains is too large, the abrasive grains tend to eat deeply into the material to be ground, thereby increasing the damage to the material to be ground. Meanwhile, if the average particle size of the abrasive grains is too small, the abrasive grains tend not to eat into the material to be ground, so that it is difficult to carry out the processing. Therefore, the average particle size of the abrasive grains is desirably from 4 to 55 μm. For example, in case of grinding a sapphire wafer, the average particle size can be from 12 to 55 μm. In case of grinding a silicon carbide (SiC) wafer which is more difficult to process, the average particle size is desirably from 4 to 20 μm.

In the present application, the average particle size is a median size of particle size distribution measured by a particle size distribution measuring instrument (laser refraction scattering method). The median size is a volume-based D50 value measured by using a laser diffraction/scattering particle size distribution measuring instrument (LA-960) by HORIBA, Ltd. in accordance with the measurement method conforming to JIS Z 8825:2013.

(Metal Powder)

As the metal powder, at least one selected from the group consisting of copper, tin, cobalt, iron, nickel, tungsten, silver, zinc, aluminum, titanium, zirconium, and an alloy thereof can be used. Generally, the metal powder preferably contains a mixture of copper and tin. For example, as for grinding the high-hardness fragile material, a composition preferably contains copper of about 30 mass % to about 70 mass % and tin of about 30 mass % to about 70 mass %.

(Pore Forming Material)

For the pore forming material, arbitrary solute particles which can easily dissolve in the solvent such as water, alcohol (methanol and ethanol, etc.), and acetone can be used. Especially, for the pore forming material, a water-soluble compound is preferable and a water-soluble inorganic salt is more preferable. As the water-soluble inorganic salt, at least one selected from the group consisting of, for example, a sodium chloride, a potassium chloride, a magnesium chloride, a calcium chloride, a sodium silicate, a sodium carbonate, a sodium sulfate, a potassium sulfate, and a magnesium sulfate is preferable.

The average particle size of the pore forming material can be set, for example, in a range from 5 to 300 μm. The size of the pores of the porous metal bonded grindstone obtained in accordance with the method for manufacturing the grindstone in the present invention corresponds to the size of the pore forming material. Therefore, the size of the formed pores can be adjusted by adjusting the particle size of the pore forming material. Further, the size of the pore forming material can be appropriately selected and used in consideration of the ease to remove it during the next step. If the average particle size of the pore forming material is too small, the vapor of the solvent is difficult to penetrate and the pore forming material is likely to remain in the molded body. Therefore, the lower limit of the average particle size is preferably at least 5 μm and may be at least 10 μm, at least 50 μm, or at least 80 μm. Meanwhile, if the average particle size is too large, the number of the formed pores decreases, there occurs portions in which a bond matrix becomes large, and bond abrasion occurs in these portions, so that such abrasive grains become unsuitable for grinding high-hardness fragile materials. Therefore, the upper limit of the average particle size is preferably at most 250 μm and may also be at most 200 μm or at most 100 μm.

The average particle size of the pores of the targeted porous metal bonded grindstone is appropriately selected depending on the size of the abrasive grains and the type of the material to be ground. In case of manufacturing the grindstone for grinding a silicon carbide (SiC) wafer using diamond abrasive grains having an average particle size of 8 μm, the average particle size of the pore forming material is preferably from 70 to 200 μm.

As described above, the average particle size of the pore forming material is the median size of the particle size distribution measured by a particle size distribution measuring instrument (laser refraction scattering method).

The porous metal bonded grindstone obtained in accordance with the method for manufacturing the grindstone in the present invention is a metal bond having pores. Therefore, the sharpness and the wear resistance are adjusted based on not a general degree of concentration, but based on the number of abrasive grains in a portion minus the pores from a grinding surface (so-called base portion). The abrasive grains, the metal powder, and the pore forming material are preferably mixed such that the number of abrasive grains in the base portion minus the pores from the grinding surface is from 700 to 6500/cm$^2$. If the number of abrasive grains in the base portion is too small, this leads to the porous metal bonded grindstone having a large amount of metal bonds per abrasive grain. Therefore, grain changeover of worn-away abrasive grains tend to be easily inhibited, so that this makes continuation of the processing difficult. If the number of abrasive grains in the base portion is too large, the weight per abrasive grain tends to become low, so that the abrasive grains do not successfully eat into the high-hardness fragile material.

The number of abrasive grains in the base portion minus the pores from the grinding surface can be calculated based on the shape of the manufactured porous metal bonded grindstone as well as the mixture ratio of the abrasive grains, the metal powder, and the pore forming material. Further, in case of counting the number of abrasive grains from the obtained porous metal bonded grindstone, it can be determined by performing binarization in an image obtained by magnifying, by 500 times, the grinding surface minus the pores of the objective porous metal bonded grindstone and then counting the number of abrasive grains per unit area (cm$^2$).

(Unfired Molded Body)

The unfired molded body is achieved by mixing the abrasive grains, the metal powder, and the pore forming material as well as filling and pressing (pressing at, for example, 500 to 5000 kg/cm$^2$) the mixture in a predetermined molding die, thereby molding it into a predetermined shape.

The volume ratio (the volume of the pore forming material/the volume of the unfired molded body×100(%)) of the pore forming material in the unfired molded body is preferably from 5 to 90 vol %. If the volume ratio of the pore forming material in the unfired molded body is smaller than 5 vol %, the grindstone would have a large number of metal bonds (would have a small number of pores). Therefore, bond abrasion is likely to occur as in a grindstone without pores, and thus the grindstone would not be suitable for grinding high-hardness fragile materials. If the volume ratio is larger than 90 vol %, the grindstone would have a small number of metal bonds for holding the abrasive grains, so that it is difficult to maintain the structure.

The porosity of the pores of the obtained porous metal bonded grindstone corresponds to the amount of the pore forming material in the unfired molded body. Therefore, the porosity of the grindstone can be arbitrarily adjusted from a low porosity to a high porosity by adjusting the amount of the pore forming material. The volume ratio of the pore forming material in the unfired molded body is preferably at least 5 vol % and may be at least 10 vol %. Further, the volume ratio of the pore forming material in the unfired molded body is preferably at most 90 vol % and may be at most 85 vol %, at most 80 vol %, at most 75 vol %, at most 70 vol %, or at most 65 vol %.

Further, in order to realize the porous metal bonded grindstone having a low porosity which has been difficult to manufacture in accordance with the conventional manufacturing method, the volume ratio of the pore forming material in the unfired molded body may be in a range from 5 to 35 vol % or from 10 to 30 vol %.

[Solute Removing Step (P2)]

The solute removing step is a step for bringing the vapor of a solvent having solubility with respect to the pore forming material into contact with the unfired molded body to remove the pore forming material and to obtain the unfired molded body having pores. In the solute removing step, usually, the unfired molded body is taken out from a molding die and the unfired molded body is brought into contact with the vapor of the solvent for melting the pore forming material. In this manner, it becomes possible to efficiently remove the pore forming material in the unfired molded body and form the pores in the portion where the pore forming material had existed.

As the method for bringing the vapor of the solvent having solubility with respect to the pore forming material into contact with the unfired molded body, there is, for example, a method for supplying, to the unfired molded body, the vapor generated by heating a solvent at its boiling point or higher and a method for introducing the unfired molded body into a processing part filled with the vapor of a solvent. For example, in case of bringing water vapor into contact with the unfired molded body, the water vapor generated by a water vapor generator can be supplied to the unfired molded body and a humidifying furnace can be used. Further, in consideration of, for example, the type of the solvent to be used and the permeability of the vapor of the solvent into the unfired molded body, the contact may take place in a pressurized state and a depressurized state.

The solvent as the vapor brought into contact with the unfired molded body has only to be a solvent by which the pore forming material is melted (i.e., having solubility with respect to the pore forming material) and can be appropriately selected depending on the type of the pore forming material. In consideration of ease in handling and vaporizing etc., the vapor of a solvent containing at least one selected from the group consisting of water, alcohol, and acetone is preferably used. More preferably, the vapor of the solvent containing water is used.

The temperature of the vapor of the solvent is preferably at least the boiling point of the solvent to be used, is preferably at or below the firing temperature during the firing step, and is appropriately set depending on the type of the solvent, etc. For example, in case of water vapor, the temperature can be set in a range from 100 to 200° C.

The time for bringing the vapor of the solvent into contact with the unfired molded body has only to be at least the time when the pore forming material can dissipate and is appropriately set depending on the type of the pore forming material and the ratio in the unfired molded body. For example, the time can be set to from 12 to 120 hours and from 24 to 72 hours.

[Firing Step (P3)]

The firing step is a step for firing the unfired molded body having pores. The firing step may be carried out by a publicly known method. For example, the unfired molded body having pores after the solute removing step is subjected to a heat processing in a firing furnace at a firing temperature preset in a range from 200° C. to 900° C. in a depressurized state or a normal pressure state, so that the metal powders are mutually melted and bonded while formed pores are in a state of being maintained, thereby forming the metal bond. In this manner, a porous fired body can be obtained.

[Porous Metal Bonded Grindstone]

The porous metal bonded grindstone obtained in accordance with the method for manufacturing the grindstone in the present invention is composed of the porous fired body. FIG. 2 is a partial cross sectional schematic drawing showing the porous metal bonded grindstone manufactured in accordance with the method for manufacturing the grindstone in the present invention. FIG. 3 is a drawing for explaining a state of the porous metal bonded grindstone at the time of grinding. As shown in FIGS. 2 and 3, a porous metal bonded grindstone 10 manufactured in accordance with the method for manufacturing the grindstone in the present invention contains a metal bond 12, abrasive grains 14, and pores 16.

The porous metal bonded grindstone 10 having the above structure has the following advantages.

As shown in FIG. 3, due to the porous structure, a contact area of the metal bond 12 in contact with a material 30 to be ground is reduced. In this manner, the bond abrasion can be alleviated and, at the same time, a contact surface pressure with respect to the material 30 to be ground can be increased. Pores 16 on a grinding surface 18 contributes as a chip pocket and is expected to improve performance of discharging chips 32 at the time of the grinding, while also improving a cooling function.

Further, in the structure of the porous metal bonded grindstone 10 are the pores 16 and therefore the strength of the porous metal bonded grindstone is lowered. Thus, an abrasive grain 14 whose lifetime is finished due to the grinding is made to fall and a self-sharpening effect for transferring the role to the next abrasive grain 14 works effectively, so that the successive grinding is possible with a stable load.

In the porous metal bonded grindstone 10, the pore diameter of the pores is from 5 to 300 μm. The pore diameter of the pores may also be at least 10 μm, at least 50 μm, or at least 80 μm. The pore diameter of the pores may also be at most 250 μm, at most 200 μm, or at most 100 μm. The pore diameter can be controlled by adjusting the particle size of the pore forming material. The value of the pore diameter is determined by respectively measuring the average diameters of the long diameters and the short diameters of 50 pores as well as further calculating the average value of the 50 pores in ten 500× magnified images of the grinding surface of the porous metal bonded grindstone.

Further, the porosity of the porous metal bonded grindstone 10 is from 5 to 90 vol %. The porosity of the porous metal bonded grindstone 10 may also be at least 10 vol %. Further, the porosity of the porous metal bonded grindstone 10 may also be at most 85 vol %, at most 80 vol %, at most 75 vol %, at most 70 vol %, or at most 65 vol %. The porosity can be controlled by adjusting the ratio of the pore forming material. The porosity is a value determined by calculating the density from the volume and the mass of the porous metal bonded grindstone as well as by calculating the calibration curve indicating the relationship between the predetermined density and the porosity (vol %).

As described above, according to the method for manufacturing the grindstone in the present invention, the porous metal bonded grindstone having a low porosity can be manufactured without using a closed-cell cellular material. For example, according to the method for manufacturing the grindstone in the present invention, it is also possible to manufacture a porous metal bonded grindstone which does not include a closed-cell cellular material such as hollow fine particles, is substantially composed of the metal bond 12, the abrasive grains 14, and pores 16 (namely, inclusion of inevitably contained impurities is not excluded), and has a low porosity such as 5 to 35 vol % or 10 to 30 vol %. Presence or absence of the closed-cell cellular material can be determined from, for example, analysis of a component of the contour of the pores.

On the grinding surface 18 of the porous metal bonded grindstone 10, the number of abrasive grains in contact with the surface is from 700 to 6500/cm$^2$. The number of abrasive grains can be controlled by adjusting the ratio of the abrasive grains, the metal powder, and the pore forming material. As described above, when the number of abrasive grains in contact with the surface is set in a range from 700 to 6500/cm$^2$, the cut depth into the material to be ground composed of a high-hardness fragile material can be ensured, so that the abrasive grains become more suitable for grinding at low load even during high-speed feeding.

The shape of the porous metal bonded grindstone manufactured in accordance with the method for manufacturing the grindstone in the present invention is not particularly limited. A molding die used at the molding step (P1) is appropriately selected depending on the usage, to make it possible to obtain the porous metal bonded grindstone (fired body) assuming arbitrary shapes such as a plate type, a square pillar type, a circular type, a ring type, and an arc type.

<Method for Manufacturing Porous Metal Bonded Wheel>

FIG. 4 is a process chart of the method for manufacturing the porous metal bonded wheel in the present invention. As shown in FIG. 4, the porous metal bonded wheel having a base metal and the porous metal bonded grindstone bonded to the base metal can be obtained by the steps of: (P4) bonding, to a base metal, the porous metal bonded grindstone manufactured in accordance with the method for manufacturing the porous metal bonded grindstone in the present invention; and (P5) finishing the porous metal bonded grindstone bonded to the base metal by using a dresser.

FIG. 5 is a perspective view showing one example of the porous metal bonded wheel obtained in accordance with the method for manufacturing the porous metal bonded wheel in the present invention. A porous metal bonded wheel 100 has a disk-type base metal 20 made from metal such as iron and aluminum as well as segment chips 22. The segment chip 22 is composed of the porous metal bonded grindstone 10. The porous metal bonded grindstone 10 is manufactured in accordance with the method for manufacturing the grindstone in the present invention. The base metal 20 is attached to a main shaft of a non-illustrated grinding machine, so that the porous metal bonded wheel 100 can be driven to rotate. The porous metal bonded wheel 100 has an outer diameter of about 250 mm and the segment chip 22 has a width of about 3 mm.

As shown in FIG. 5, a plurality of segment chips 22 are fixed annularly lined along an outer circumferential edge of a lower surface of the base material 20. In the porous metal bonded wheel 100, the segment chips 22 constitute an annular grinding surface 18, which protrudes toward one surface side (in a direction parallel to a rotary shaft core (downward in FIG. 5)). Next, the segment chips 22 bonded to the base metal are finished by means of a dresser. In this manner, the porous metal bonded wheel 100 can be obtained.

Further, in the porous metal bonded wheel 100, the segment chips 22 are composed of the porous metal bonded grindstones 10, while the bonding may take place such that only the surface layers of the segment chips 22 are composed of the porous metal bonded grindstones 10.

The porous metal bonded wheel 100 can be used for grinding high-hardness fragile materials such as a silicon carbide (SiC) wafer or a sapphire wafer. The porous metal bonded grindstone 10 of the porous metal bonded wheel 100 makes the grinding surface 18 slidably contact with the high-hardness fragile materials such as a silicon carbide (SiC) wafer or a sapphire wafer, accompanied by rotation of the base metal 20, thereby grinding the high-hardness fragile materials into a flat type.

EXAMPLES

Hereinafter, the present invention will be further explained in detail by way of examples. The present invention is not limited to the examples shown below as far as its gist is not changed.

[Example 1]: Manufacture of Test Piece of Porous Metal Bonded Grindstone

Materials

Abrasive grains: Diamonds (average particle size of 8 μm)

Metal powder (material which forms a metal bond): Mixture of Cu of 60 mass % and Sn of 40 mass %

Pore forming material: Sodium sulfate (average particle size of 70 μm)

Manufacturing Method

As shown in Table 1, a molding die is filled with a mixture of predetermined abrasive grains, metal powder, and pore forming material and subjected to pressure (500 to 5000 kg/cm$^2$, room temperature), so that an unfired molded body was obtained.

Next, the unfired molded body was taken out from the molding die and was exposed to a water vapor atmosphere (100 to 200° C.) for 72 hours.

After exposed to the water vapor, the unfired molded body was fired (at 200 to 900° C.), so that the test piece (size: 40 mm in length×7 mm in width×4 mm in thickness) of the porous metal bonded grindstone was obtained.

TABLE 1

| | (Abrasive grains + metal powder):pore forming material (Volume ratio) | The number of abrasive grains in the base portions (number of pieces/cm$^2$) | Porosity (vol %) | Pore diameter (μm) |
|---|---|---|---|---|
| Example 1-1 | 90:10 | 700 | 10 | 70 |
| Example 1-2 | 70:30 | 700 | 30 | 70 |
| Example 1-3 | 50:50 | 700 | 50 | 70 |
| Example 1-4 | 10:90 | 700 | 90 | 70 |

The cross sections of the manufactured test pieces in Examples 1-1 to 1-4 were observed by using an SEM/EDS apparatus. As a result of performing EDS analysis on all the test piece cross sections, no residues of the pore forming material were observed and it could be confirmed that all the residues dissipated. Further, as a result of performing particle analysis by binarization of the SEM images (500×) of the test piece cross sections, all the test pieces indicate the same area ratio as the designed porosity and it could be confirmed that the porous metal bonded structure as designed was realized. Further, it could be confirmed that the pore diameter also corresponds to the average particle size of the pore forming material used.

Example 2

Except for changing the molding die, so that the size of the obtained porous metal bonded grindstone is 35 mm in length, 3 mm in width, and 9 mm in thickness, the porous metal bonded grindstone having the porosity in Table 2 was manufactured in the same manner as in Example 1.

The obtained porous metal bonded grindstones were bonded to the underside of the base metal having an outer diameter of 300 mm as shown in FIG. 5, so that the porous metal bonded wheel was manufactured.

The processing test for the high-hardness fragile material was performed by using the porous metal bonded wheel in Example 2 under the following grinding test conditions in order to evaluate the grinding resistance and the grindstone wear rate. The results are shown in Table 2.

The grinding resistance is a driving current value of the electric motor for driving and rotating the porous metal bonded grindstone during the grinding under the following grinding test conditions. Further, the grindstone wear rate is determined by indicating, as a rate, a wear amount of a grindstone sample in one grinding under the following grinding test conditions and by dividing a wear amount (thickness) of the grindstone by a machining allowance (thickness) of a workpiece. For example, if the grindstone wears by 100 μm at the time of machining a wafer (workpiece) with a machining allowance by 50 μm, the grindstone wear rate is 200%.

(Grinding Test Conditions)

- Grinding machine: flat surface grinding machine (infeed system)
- Grinding method: wet-type flat surface grinding
- Workpiece: 4-inch single crystal silicon carbide (SiC) wafer
- Machining conditions: the number of grindstone rotations of 2400 rpm, the number of wafer rotations of 400 rpm, cutting speed of 0.5 μm/sec, and machining allowance of 200 μm
- Grinding fluid: Water-soluble grinding fluid

Comparative Example

The same as in Example 1 applied except for not using the pore forming material, so that the metal bonded grindstone having a porosity of 0 vol % was obtained. As in Example 2, the grinding test was performed by using the metal bonded wheel in which the obtained metal bonded grindstones are bonded to the base metal. The results are shown in Table 2.

TABLE 2

| | Porosity (vol %) | Grinding resistance (A) | Grindstone wear rate (%) |
|---|---|---|---|
| Example 2-1 | 10 | 15.8 | 0.70 |
| Example 2-2 | 30 | 14.5 | 3.80 |
| Example 2-3 | 50 | 13.1 | 24.50 |
| Example 2-4 | 90 | 10.5 | 113.90 |
| Comparative example | 0 | Machining is impossible | |

It could be confirmed that, the higher the porosity was, the lower the machining resistance became and meanwhile, the wear amount tended to increase. It could also be confirmed that achieving a low porosity was effective for improving the wear resistance as a tool.

Example 3

The porous metal bonded grindstone was manufactured by using the pore forming material having the average particle size shown in Table 3, and was manufactured in the same manner as in Example 1 except for the porosity being 60 vol % and the number of abrasive grains being 700/cm$^2$. As in Example 2, the grinding test was performed by using the porous metal bonded wheel in which the obtained porous metal bonded grindstones are bonded to the base metal. The results are shown in Table 3.

TABLE 3

| | Average particle size of the pore forming material (μm) | Grinding resistance (A) | Grindstone wear rate (%) |
|---|---|---|---|
| Example 3-1 | 5 | 16.1 | 52.6 |
| Example 3-2 | 70 | 12.9 | 36.9 |
| Example 3-3 | 120 | 11.7 | 11.3 |
| Example 3-4 | 160 | 11.2 | 10.1 |
| Example 3-5 | 250 | 12.5 | 5.7 |
| Example 3-6 | 300 | 15.3 | 2.8 |

Example 4

A porous metal bonded wheel was manufactured by bonding porous metal bonded grindstones having the number of abrasive grains in the base portions as shown in Table 4, a pore diameter of 70 μm, and a porosity of 60 vol %. The grinding test was performed by using these grindstones. The results are shown in Table 4.

TABLE 4

| | The number of abrasive grains in the base portions (number of pieces/cm$^2$) | Grinding resistance (A) | Grindstone wear rate (%) |
|---|---|---|---|
| Example 4-1 | 700 | 12.9 | 36.9 |
| Example 4-2 | 1650 | 13.2 | 32.1 |

TABLE 4-continued

| | The number of abrasive grains in the base portions (number of pieces/cm$^2$) | Grinding resistance (A) | Grindstone wear rate (%) |
|---|---|---|---|
| Example 4-3 | 2300 | 13.5 | 24.8 |
| Example 4-4 | 3650 | 15.2 | 16.6 |
| Example 4-5 | 5800 | 16.7 | 13.8 |
| Example 4-6 | 6500 | 16.9 | 13.1 |

INDUSTRIAL APPLICABILITY

The method for manufacturing the porous metal bonded grindstone in the present invention allows the grindstones having various porosities to be manufactured. The obtained grindstone and the porous metal bonded wheel comprising this grindstone can be used for grinding high-hardness fragile materials such as silicon carbide (SiC) wafer or sapphire wafer.

REFERENCE SIGNS LIST

10 Porous metal bonded grindstone
12 Metal bond
14 Abrasive grains
16 Pore
18 Grinding surface
20 Base metal
22 Segment chip
30 Material to be ground
32 Chip
100 Porous metal bonded wheel

The invention claimed is:

1. A method for manufacturing a porous metal bonded grindstone, comprising:

a molding step for obtaining an unfired molded body including abrasive grains, metal powder and a pore forming material;

a solute removing step for bringing vapor of a solvent having solubility with respect to the pore forming material into contact with the unfired molded body to remove the pore forming material and to obtain an unfired molded body having pores; and a firing step for firing the unfired molded body having pores.

2. The method for manufacturing a porous metal bonded grindstone according to claim 1, wherein a volume ratio of the pore forming material to the unfired molded body is from 5 to 90 vol %.

3. The method for manufacturing a porous metal bonded grindstone according to claim 1, wherein an average particle size of the pore forming material is from 5 to 250 μm.

4. The method for manufacturing a porous metal bonded grindstone according to claim 1, wherein the solvent contains at least one selected from the group consisting of water, alcohol, and acetone.

5. The method for manufacturing a porous metal bonded grindstone according to claim 1, wherein the solvent contains water and the pore forming material is a water-soluble compound.

6. The method for manufacturing a porous metal bonded grindstone according to claim 5, wherein the pore forming material is a water-soluble inorganic salt.

7. A method for manufacturing a porous metal bonded wheel, comprising the steps of:

bonding, to a base metal, a porous metal bonded grindstone manufactured in accordance with the method for manufacturing the porous metal bonded grindstone according to claim 1; and finishing the porous metal bonded grindstone bonded to the base metal by using a dresser.

* * * * *